United States Patent [19]

McCormack et al.

[11] 4,301,196

[45] Nov. 17, 1981

[54] ELECTROLESS COPPER DEPOSITION PROCESS HAVING FASTER PLATING RATES

[75] Inventors: John F. McCormack, Roslyn Heights; Francis J. Nuzzi, Freeport, both of N.Y.

[73] Assignee: Kollmorgen Technologies Corp., Dallas, Tex.

[21] Appl. No.: 191,068

[22] Filed: Sep. 26, 1980

Related U.S. Application Data

[63] Continuation of Ser. No. 941,912, Sep. 13, 1978, abandoned.

[51] Int. Cl.[3] ..... C23C 3/02

[52] U.S. Cl. ..... 427/305; 106/1.23; 427/345; 427/443.1; 427/98

[58] Field of Search ..... 427/305, 345, 443.1, 427/98; 106/1.23

[56] References Cited

U.S. PATENT DOCUMENTS

| | | | |
|---|---|---|---|
| 3,222,195 | 12/1965 | Pearlstein | 427/305 |
| 3,257,215 | 6/1966 | Schneble et al. | 427/430 A |
| 3,377,174 | 4/1968 | Torigai et al. | 106/1.23 |
| 3,436,233 | 4/1969 | Jackson | 106/1.23 |
| 3,645,749 | 2/1972 | Paunovic | 427/430 A |
| 3,708,329 | 1/1973 | Schoenberg | 427/306 |
| 3,793,038 | 2/1974 | Maguire | 427/305 |
| 3,804,638 | 4/1974 | Jonker et al. | 106/1.23 |
| 3,843,373 | 10/1974 | Molenaac et al. | 106/1.23 |
| 4,002,786 | 1/1977 | Hirohata et al. | 427/430 A |

FOREIGN PATENT DOCUMENTS

| | | | |
|---|---|---|---|
| 49-59042 | 6/1974 | Japan | 427/430 A |

OTHER PUBLICATIONS

Jonker et al., "Principles of PD Recording Systems and Their Use in Photofabrication", Journal of Photographic Science, 19, 1971.

Pushpavanam et al., "Electroless Copper Plating" Finishing Industries, vol. 1, No. 10, Oct. 1977 pp. 36, 37, 43.

Pearlstein, "Electroless Plating", Modern Electroplating, John Wiley & Sons, ©1974 pp. 734–739.

*Primary Examiner*—John D. Smith

*Attorney, Agent, or Firm*—Morgan, Finnegan, Pine, Foley & Lee

[57] ABSTRACT

There is provided a method for increasing the useful effective plating rate of an electroless copper deposition solution which comprises copper ion, a complexing agent for copper ion, a reducing agent and a pH adjustor and which is characterized by a plating rate which first increases and passes through a peak plating rate and then decreases as a function of a pH above 10. In accordance with this invention, the plating rate of such a solution may be significantly increased by operation thereof in the presence of an accelerating or depolarizing agent at a pH to achieve a plating rate above the plating rate of the solution without such an agent at the same pH. The accelerating or depolarizing agents for use herein include compounds containing a delocalized pi-bond, such as heterocyclic aromatic nitrogen and sulfur compounds, non-aromatic nitrogen compounds having at least one delocalized pi-bond, and aromatic amines.

22 Claims, 5 Drawing Figures

ELECTROLESS COPPER DEPOSITION PROCESS HAVING FASTER PLATING RATES

This is a continuation of application Ser. No. 941,912 filed Sept. 13, 1978 now abandoned.

BACKGROUND OF THE INVENTION

Electroless, i.e., autocatalytic, metal deposition solutions for the formation of metal layers on non-metallic or metallic substrates are well known in the art. These are characterized by the capacity to deposit metal in virtually any desired thickness on a wide variety of surfaces without the need for an external supply of electrons. Such solutions differ from electroplating baths which require an externally supplied source of electrons, and they also differ from displacement metal plating and metal mirroring methods where the metal deposited is only a few millionths of an inch in thickness. Electroless metal deposition solutions are especially suitable for forming metal layers on the surface of non-metallic or resinous articles which have been pretreated to render the surface catalytic to the electroless reception of metal.

Special mention is made of the use of electroless metallizing procedures in the plating of plastics generally and the manufacture of printed circuit boards particularly. In the plating of plastics, a thin layer of copper is electrolessly deposited on the sensitized surface of a resinous article, e.g., an insulating material, to produce a metallized or metal plastic part for use, e.g., in the automobile industry, as grills, door knobs and the like. In the manufacture of printed circuit boards, a thin layer of copper is electrolessly deposited on a sensitized surface of an insulating substratum, selected areas of the surface of the electroless deposit are masked, the initial layer of unmasked copper is then built up by electroplating, and the masked areas of copper are etched away after removal of the masking layer to leave the desired conducting pattern of copper on the surface. In another procedure, selected areas of the surface of the insulating substratum are sensitized in the form of a desired printed circuit pattern and copper is electrolessly deposited on the sensitized areas to form the desired circuit pattern. In the manufacture of printed circuit boards, electroless metal deposition techniques are also often used to plate the sensitized walls of through-holes formed in the insulating article in order to e.g., produce electrically conductive connections, so-called plated through holes, between circuit patterns formed on opposite sides of the article surface.

A shortcoming of early processes for the electroless deposition of copper was that the deposition solution was unstable initially or became unstable after a relatively brief operating period and then had to be dumped. Such solutions also tended to produce electrolessly formed copper deposits which were dark in color and which tended to flake off the substratum on which deposition was taking place. To overcome such shortcomings, the art has proposed a number of compounds as stabilizing agents for prolonging the useful life of electroless metal deposition solutions and for improving the quality of copper deposit. These include 2-mercaptobenzothiazole, in Pearlstein, U.S. Pat. No. 3,222,195; 2,5-dimercapto-1,3,4-thiodiazole and 8-mercaptopurine, in Jackson, U.S. Pat. No. 3,436,233; o-phenanthroline, in Stone, U.S. Pat. No. 3,615,735; 1-phenyl-5-mercaptotetrazole, in Jonker et al, U.S. Pat. No. 3,804,638; 2,2'-dipyridyl and 2-(2-pyridyl)-benzimidazole, in Hirohata et al, U.S. Pat. No. 4,002,786; and benzothiazole-thioetherpolyethyleneglycol, in Molenaac et al, U.S. Pat. No. 3,843,373.

Still other stabilizing agents are disclosed in Schneble et al, U.S. Pat. No. 3,257,215, for example, thiazoles isothiazoles and thiozines, Maguire, U.S. Pat. No. 3,793,038, for example, benzotriazole, diazole, imidazole, guanidine, pyrimidine, and others and Torigai et al, U.S. Pat. No. 3,377,174, for example, 2,2'-biquinoline, 2,9-dimethylphenanthroline and 4,7-diphenyl-1,10-phenanthroline.

Schoenberg, U.S. Pat. No. 3,708,329, discloses that the addition of a heterocyclic aromatic nitrogen compound having up to 3 rings with a hydroxy group bonded to one of the rings, results in a marked increase in the stability of electroless copper plating baths without adversely affecting the plating rate. See also Schoenberg, the Journal of the Electrochemical Society, 118, 1571 (1971). Although Schoenberg in U.S. Pat. No. 3,708,320 talks about improving plating rate, the fastest bath described by Schoenberg has a room temperature plating rate of only 3.1 microns per hour. Even that slow rate, however, is higher than any long term rate mentioned in any of the other prior art references identified above. The fastest reported long term rate for electroless copper plating solutions currently available commercially, e.g., Dynachem DC-920 and MacDermid 9027, is 5 microns per hour. U.S. Pat. No. 3,377,174 reports a short term plating rate of 0.5 microns in a five minute period.

Heretofore, it was considered necessary to operate electroless copper solutions at a low rate, i.e., less than about 6 microns per hour so as to produce a copper deposit of good quality, i.e., a coherent, structurally stable, thin film of copper adherent to the surface being coated. The experience in the art has further been that plating rates above about 6 microns per hour resulted in the production of a copper deposit of poor quality, i.e., one which flakes off or tends to flake off the surface or which was non-coherent.

As used herein, the phrase adherent copper deposit refers to an electrolessly formed copper deposit which can be stripped from a plated insulating substratum in the form of a thin, integral film such that when stripped, retains its structural integrity or cohesiveness as a film without crumbling.

As used herein, the phrase non-adherent copper deposit refers to an electrolessly formed copper deposit which flakes or tends to flake off the coated substratum. Such a deposit lacks cohesiveness and cannot be stripped from the insulating substratum in the form of a thin, stable, structurally integral film.

It is one object of this invention to increase the rate at which copper can be electrolessly formed.

It is a further object of this invention to provide procedures and compositions for increasing the rate for electrolesssly forming an adherent copper deposit.

Another object of this invention is to provide electroless copper deposition solutions having high plating rates.

Still another object of this invention is to provide compositions and procedures for electrolessly forming adherent copper deposits at high rates heretofore considered unachieveable.

Other and further objects of this invention will be clear from the description which follows and from the examples.

In accordance with the invention, it has been found that these and other objects may be achieved by operating a given electroless copper solution of the type disclosed in the presence of an acceleratoor or depolarizing agent at a pH greater than the peak plating rate pH of the solution without such an agent. In general, the depolarizing agent should be capable of achieving at least 20% and up to 100% or between about 35% and 90% depolarization of the anodic partial reaction or the cathodic partial reaction of the solution, or both. Stated differently, the depolarizing agent should be capable of accelerating by at least 20% and up to 100% or between about 35 and 90%, the cathodic partial reaction or the anodic partial reaction of the solution, or both.

The increase in the rate at which adherent copper may be deposited from a given electroless copper solution by practice of this invention will vary over a wide range depending upon the formulation used and the quality of copper desired. In general, rate increases achieved by practice of this invention will be at least up to 300% or more depending upon solution formulation. However, rate increases of up to 1 or 1½ orders of magnitude, i.e., 10 times (1000%) or even 50 times (5000%) are possible. Achievement of such rate increases was unexpected and surprising.

Similarly, the rate at which adherent copper may be deposited for a prolonged period of time from a given electroless copper solution by practice of this invention will vary over a wide range, again depending upon the formulation used and the quality of copper desired. With additive present, the solutions covered herein are characterized by a room temperature plating rate above 7 microns per hour, and generally above 9 microns per hour, or between about 9 and 25 microns per hour and higher and are characterized by the ability to electrolessly form copper at a rate of up to at least 30 microns per hour for a period of at least 15 minutes. Elevated temperature rates of up to 70 microns per hour or even higher are however possible. Here again, achievement of such rates was unexpected and surprising. Moreover, such rates may be achieved for periods of time ranging from one or several minutes up to prolonged periods up to eight hours or more. Typical are operating times of about 5 minutes to about 8 hours. With proper replenishment, the solutions may continue in use for extended periods of time, e.g., weeks. It should be noted that the fast rates of the solutions generally make prolonged plating periods unnecessary.

Electroless formation of copper in accordance with this invention will result in many operating advantages, including shorter plating times and, concomitantly, increased production capacity. Compared to commercial practices now available, the procedures and compositions of this invention require less equipment, lower capital investment costs and lower energy requirements. Unlike the current commercial practices, the procedures herein taught are particularly suitable for use in automatic plating systems with relatively short dwell times.

DESCRIPTION OF THE INVENTION

This invention provides a method for operating an electroless copper deposition solution to increase the plating rate. The solution comprises copper ion, a complexing agent for copper ion, a reducing agent and a pH adjustor and is characterized by a plating rate which first increases and passes through a peak plating rate and then decreases as a function of pH above 10 and usually above 11. The method of invention comprises:

(A) operating the electroless copper deposition solution in the presence of at least one accelerating or depolarizing agent, and (B) regulating the pH of the electroless copper deposition solution in the presence of the accelerating or depolarizing agent so as to electrolessly deposit copper at a rate greater than the plating rate of the solution without the accelerating agent at the same pH.

Preferably, the accelerating or depolarizing agent is selected from among compounds containing a delocalized pi-bond, including (a) heterocyclic aromatic nitrogen and sulfur compounds, (b) non-aromatic nitrogen compounds having at least one delocalized pi-bond, (c) aromatic amines, and (d) mixtures of any of the foregoing, Usually, the bath is operated at a pH greater than the peak plating rate pH of the solution without the accelerating or depolarizing agent present.

The terms "depolarizing agent" and "accelerating agent" are use interchangeably herein.

The preferred depolarizing or accelerating agents of this invention have a free electron pair on the nitrogen atom adjacent to a pi-bond.

By way of illustration, the heterocyclic aromatic nitrogen compound, (A)(a), is selected from among pyridine, e.g., pyridine, cyanopyridine, chloropyridine, vinylpyridine, aminopyridine, 2-pyrazolo-(4,3-c)-pyridine, 3-v-triazolo(4,5-b)pyridine, 2,2'-dipyridyl, picolines, and the like; pyridazine; pyrimidines, e.g., m-diazine, 2-hydroxypyrimidine, 2-oxy-6-aminopyrimidine (cytosine), and the like; pyrazines; triazine; tetrazine; indoles, e.g., indole, tryptamine, tryptophan, 2,3-indolinedione, indoline, and the like; purines, e.g., 6-aminopurine (adenine); phenanthrolines, e.g., o-phenanthroline; quinolines, e.g., 8-hydroxyquinoline; azoles e.g., pyrrole, dibenzopyrrole, pyrroline, and the like; diazoles, e.g., 1,2-pyrazole, 1,3-imidazole, and the like; triazoles, e.g., pyrrodiazole, benzotriazole, diphenyltriazole, isotriazoles, and the like; tetrazoles, and benzodiazoles, e.g., indazole, benzimidazole and the like.

Also included are mercapto-derivatives and thioderivatives of any of the foregoing, such as mercaptopyridines, mercaptopyrimidines, thiazoles, thiazoline, thiazolidine, mercaptothiazoles, imidazolethiols, mercaptoimidazole, mercaptopurines, mercaptoquuinazolinones, thiodiazoles, mercaptothiodiazoles, mercaptotriazoles, mercaptoquinolines, and the like.

Illustratively, the non-aromatic nitrogen compound, (A)(b), is selected from among ureas, guanidines and derivatives thereof.

Preferably, the aromatic amine, (A)(c), is selected from among p-nitrobenzylamine, anilines, phenylenediamines and mixtures thereof.

Preferably, the depolarizing or accelerating agent will be present in a small effective amount, i.e., generally at least about 0.0001 to about 2.5 grams per liter, more specifically about 0.0005 to 1.5 grams per liter and preferably from about 0.001 to about 0.5 grams per liter. In general, the amount of depolarizing or accelerating agent used will vary depending upon the particular agent employed and the formulation of the solution.

In another aspect of this invention, the electroless metal deposition solution can also include, in addition to copper ion, an ion of a metal or metals selected from among the transition metals, preferably Group VIII, and especially preferably cobalt and/or nickel. These may be added in the form of metal salts, e.g., halides or sulfates, optionally with a suitable complexing agent, e.g., a tartrate. In general, amounts of from about 0.005 to about 30%, by weight of the Group VIII metal based on the weight of the copper salt, are used.

The copper ion is normally supplied in the form of a water soluble copper salt. THe choice of the salt is chiefly a matter of economics. Copper sulfate is frequently preferred, but copper halides, e.g., chloride and bromide, copper nitrate, copper acetate, as well as other commercially available organic and inorganic acid salts or copper can also be used. Although water soluble metal salts are preferred, normally water insoluble compounds, such as copper oxide or copper hydroxide, can be used since these are rendered soluble by the complexing agent or agents in the deposition solution.

The complexing agent for copper ions is selected from compounds conventionally employed for this purpose, including but not limited to Rochelle salts, the sodium (mono-, di-, tri- and tetrasodium) salts of ethylenediaminetetraacetic acid (hereinafter sometimes referred to as "EDTA"), diethylenediaminepentaacetic acid, nitriloacetic acid and its alkali salts, gluconic acid, gluconates, triethanolamine, diethylaminoethanol and glucono δ-lactone, as well as modified ethylenediamineacetates, e.g., N-hydroxyethylethylenediaminetriacetate, phosphonates, e.g., ethylenediaminetetra (methylene phosphonic acid) and hexamethylenediaminetetra (methylene phosphonic acid).

Preferably, the complexing agent is of the alkanolamine type. Examples include N,N,N',N'-tetrakis-(2-hydroxypropyl)ethylenediamine (hereinafter sometimes referred to as "Quadrol"), triethanolamine, ethylenenitrilotetraethanol, nitrilotri-2-propanol, tetrahydroxyethylenediamine and N-hydroxyethyl-N,N'-N'(trihydroxypropyl) ethylenediamine. These are commercially available or can be prepared by following procedures described in the literature, The reducing agent is selected from among, illustratively, formaldehyde and formaldehyde precursors or derivatives, e.g., paraformaldehyde, trioxane, dimethylhydantoin, glyoxal, and the like; boranes; borohydride; hydroxylamines; hydrazines and hypophosphite.

The pH may be regulated by the use of a pH adjustor, preferably a water soluble alkali metal or alkaline earth metal hydroxide, e.g., magnesium hydroxide, calcium hydroxide, potassium hydroxide, sodium hydroxide, or the like. Among these sodium hydroxide is preferred, chiefly for reasons of economy. During operation, the pH is monitored and raised or lowered, as needed, by the addition of suitable amounts of the pH adjustor.

Other ingredients can also be added. For instance, it may be desirable to employ a minor, effective amount of a wetting agent or agents, preferably in amounts of less than 5 grams per liter. Examples of such commercially available surfactants include PLURONIC P85, BASF-Wyandotte Corp., a nonionic block copolymer of ethylene oxide and propylene oxide and GAFAC RE 610, GAF Corp., an anionic phosphate ester.

The concentrations of the various ingredients in the basic electroless copper deposition solution for use herein are subject to wide variation within certain ranges which may be defined as follows:

| | |
|---|---|
| Copper salt | 0.002 to 1.20 mole |
| Reducing agent | 0.03 to 3 moles |
| Cupric ion complexing agent | 0.5 to 20 times the moles of copper |
| Alkali metal hydroxide | sufficient to give a pH of 10.0 to 14.0 and preferably of 11.0 to 14.0, as measured at room temperature |
| Water | sufficient to make 1 liter |

When non-aqueous solvents are used instead of water, preferably they are selected from among, for example, dimethylformamide, dimethylsulfoxide and acetyl acetate.

More preferably, the plating baths of the present invention are compounded within more narrow limits than set forth immediately above, and the preferred embodiments comprise:

| | |
|---|---|
| A soluble cupric salt, preferably cupric sulfate | 0.002 to 0.4 mole |
| Alkali metal hydroxide, preferably sodium hydroxide, to give | pH 11.2 to 13.7, as measured at room temperature |
| Formaldehyde (reducing agent) | 0.06 to 0.50 mole |
| Cupric ion complexing agent | 0.002 to 2.0 mole |
| Water | sufficient to make 1 liter |

In practice, concentrated solutions or compositions can be manufactured for subsequent dilution to operating compositions as described herein.

In considering the general formula and the specific working formulae which are set forth below, it should be understood that as the baths are used up in plating, the cupric salt, the reducing agent and the cupric ion complexing agent and the depolarizing compound may be replenished from time to time.

In operation, the pH of the solution and the presence of depolarizing compound in the solution will be monitored and adjusted as taught herein. The depolarizing compound will be supplied in an amount of at least 0.0001, preferably at least 0.0005, up to about 2.5 gram/liter. With the depolarizing compound present, the pH of the solution will be adjusted as desired to achieve a faster plating rate in comparison with the solution without the accelerating agent at the same pH. Preferably, but not necessarily, the pH of the solution is adjusted to be the greater than the peak plating rate pH of the solution without the depolarizing agent.

In using the baths, the surface to be plated should be free of grease and other contaminating material.

Where a non-metallic surface is to be plated, the surface areas to receive the deposit should first be treated, as in conventional processes, with a conventional sensitizing and seeding solution, such as stannous chloride ($SnCl_2$), followed by treatment with a dilute solution of palladium chloride ($PdCl_2$).

Alternatively, extremely good sensitization is achieved by using an acidic solution prepared from stannous chloride and precious metal chloride, such as palladium chloride, the stannous chloride being present in stoichiometric excess, based on the amount of precious metal chloride. These are well known in the art.

Where a metal surface, such as copper foil, is to be treated, it should be degreased, and then treated with acid, such as hydrochloric or phosphoric acid, to free the surface of any oxide.

For inert metals, e.g., stainless steel, improved deposition is achieved if the metal foil is immersed in a palladium chloride/hydrochloric acid solution for about 1 minute prior to exposure to the plating solution.

Following pre-treatment and/or sensitization, the surface to be plated is immersed in or otherwise exposed to, as by spraying or slurry, the autocatalytic copper baths, and permitted to remain in the bath until a copper deposit of the desired thickness has been built up. In practice, the substratum or article or part being coated can be stationary and the solution moved into contact therewith, or, alternatively, the solution or offset or part being plated can be continuously conveyed through a tank or other reservoir containing the plating solution or a spray curtain of the plating solution.

In general, the electroless metal deposition solution is prepared by adding the complexing agent to an aqueous solution of the copper salt or salts to form a water-soluble complex or chelate of the copper cation. The complexing agent can be added as a base, salt or other water-soluble derivative. The other ingredients are thereafter dissolved in the solution in any desired order.

The process of this invention can be conducted over a broad range of temperatures. For example, temperatures of between 15° and boiling, e.g., 100° C., can be used, and temperatures of between 20° and 80° C. are preferred. It is noteworthy that bright adherent copper deposits are obtained at good rates even at room temperature, e.g., about 25° C.

The process of this invention is employed to electrolessly deposit copper on non-metallic or insulating surfaces, such as paper, glass, ceramics, synthetic resins and plastics, e.g., silicones, phenolics, alkyds, epoxies, styrenes, acrylics, vinyl chlorides, nylon, mylar, acrylonitrile-butadiene-styrene, and the like.

Applications of the invention include the high speed application of conductive metal layers on normally non-conductors for purposes of static elimination, or insulated cable for coaxial cable formation or on glass for copper mirroring.

The fast deposition rates achievable by the use of this invention make possible the formation of metal layers by electroless deposition at rates which are comparable to those obtained by conventional electroforming copper techniques and electroless nickel techniques.

This invention is especially useful in the manufacture of printed circuit boards and the metallizing of plastic articles. By way of illustration, whole or selected portions of the surface of an insulating article, e.g., phenolic paper, epoxy-glass laminate, molded acrylonitrile-butadiene-styrene terpolymer or platable nylon or polysulfone surfaces, are pretreated to sensitize the surface to the electroless deposition of copper. After sensitization, the article is immersed in an electroless copper deposition solution, such as described herein, and permitted to remain there until a layer of copper is deposited on the surface. The copper layer can be built up to a desired thickness by further electroless metal deposition or by electroplating with copper or combinations of metals such as copper, nickel and chromium.

In the case of printed circuit board manufacture, if desired, interconnections between opposite surfaces of the insulating article can be provided by drilling or punching holes therethrough, and sensitizing the walls of the through-holes prior to exposure to an electroless metal deposition bath. Copper builds up on the walls of the holes to form interconnections.

When formaldehyde is the reducing agent, the electroless copper deposition reaction can be represented as being divided into partial reactions:

A. $CH_2O + 2OH^- \rightarrow HCOO^- + \frac{1}{2}H_2 + H_2O + 1e^-$

C. $Cu^{++} + 2e^- \rightarrow Cu^\circ$.

Without wishing to be bound by any theory, in analogy to electroplating, the "A" partial reaction is the anodic reaction and the "C" partial reaction is a cathodic reaction. If the surface being electrolessly plated with copper is made anodic in an electrolytic cell, the rate of anodic reaction will increase with an increase in current density. As the current density increases, the potential or polarization of the surface becomes more positive. When the electroless copper deposition solution is modified by adding an accelerating or depolarizing agent according to this invention, the positive potential or polarization resulting from a given current density is less than the potential, or polarization, obtained from the deposition solution without the accelerating agent. This difference in potential or depolarization is a measure of the acceleration of the anodic reaction.

Polarization measurements may be performed by standard galvanostatic electrochemical techniques in which a predetermined current is passed through the solution from the anode to the cathode. When the anode is the test electrode, the current passing between the anode and the cathode will induce a polarization of the test electrode, the anode. The polarization is the difference of the potential between the test electrode and a reference electrode, e.g., saturated calomel electrode, when current is passing and when no current is passed, e.g., at equilibrium.

DESCRIPTION OF THE DRAWINGS

The instant invention will be more fully understood from the following description taken with the appended drawings, in which

With reference to FIG. 1, depolarization D measures the decrease of the polarization P, at the current density i, effected by the presence of an accelerating agent according to this invention. The percent depolarization expresses the same effect in terms of percent. If D is zero, there is no acceleration based upon depolarization. Larger values of D correspond to greater accelerations.

Figure 1:
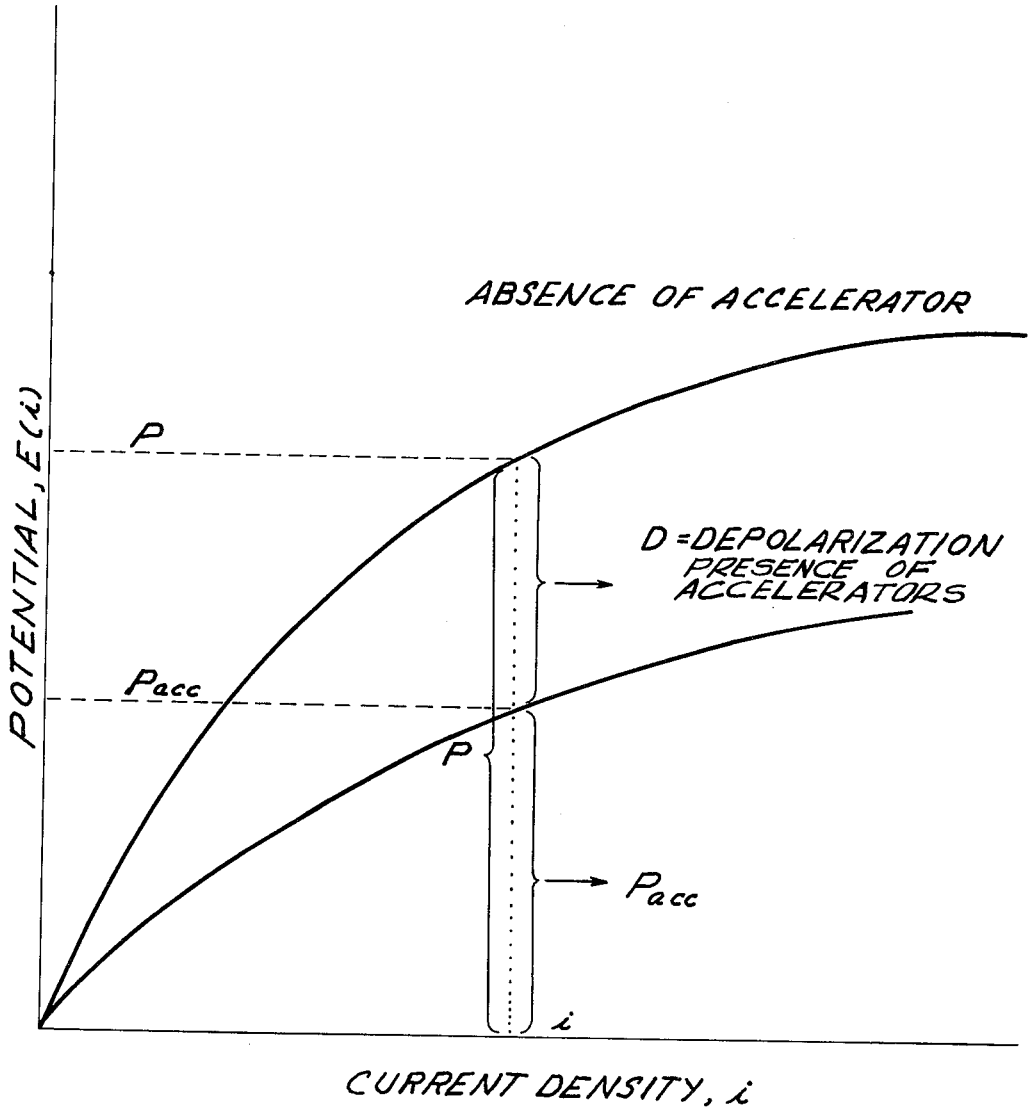
FIG. 1 is a graph in which current density and potential are plotted for a solution without an accelerator and for the same solution with an accelerator to show the effect on polarization according to the invention.

Similarly, with respect to cathodic polarization, if a surface being plated in an electroless copper solution is made the negative electrode of an electrolytic cell, it will provide the means to measure the cathodic reaction. In a similar manner, the depolarization of the cathodic reaction by an accelerating agent is a measure of the acceleration of the cathodic reaction.

The accelerating effects of the agents on the anodic or cathodic reactions have been found to vary with the ligand or complexing agent for the copper ion.

Using electroless deposition solutions having the formulations stated below, the percent depolarization effected by a number of the accelerating agents taught herein was measured.

| BATH FORMULATIONS FOR TABLES I AND II | |
|---|---|
| **TARTRATE LIGAND BATH** | |
| Rochelle salt | 54.3 g/l |
| Formaldehyde (37% soln.) | 10 ml/l |
| $CuSO_4 \cdot 5H_2O$ | 18.0 g/l |
| Rochelle salt:Copper (Molar ratio) | 5.0:1 |
| pH | 12.8 |
| Temperature | 25° C. ± 1° C. |
| Atmosphere | Argon purged |
| Accelerating agent | 0.001 g/l |
| **QUADROL LIGAND BATH** | |
| [N,N,N',N'-tetrakis-(2-hydroxypropyl)ethylenediamine] | 34 g/l |
| Formaldehyde (37% Soln.) | 10 ml/l |
| $CuSO_45H_2O$ | 18.0 g/l |
| Quadrol:Copper (Molar ratio) | 1.6:1 |
| pH | 12.8 |
| Temperature | 25° C. ± 1° C. |
| Atmosphere | Argon purged |
| Accelerating agent | 0.001 g/l |
| **EDTA LIGAND BATH** | |
| EDTA, disodium salt | 43.3 g/l |
| Formaldehyde (37% soln.) | 10 ml/l |
| $CuSO_4 \cdot 5H_2O$ | 18.0 g/l |
| $Na_2EDTA$:Copper (Molar ratio) | 1.6:1 |
| pH | 12.8 |
| Temperature | 25° C. ± 1° C. |
| Atmosphere | Argon purged |
| Accelerating agent | 0.001 g/l |

In measuring percent depolarization, the galvanostatic current was supplied by a Hewlett-Packard HP 6177C constant current DC power supply and the resulting polarization potential recorded on a Hewlett-Packard 7004A X, Y recorder. The test results are summarized in Table I.

TABLE I

| Anodic and Cathodic Percent Depolarization | | | |
|---|---|---|---|
| | | Percent Depolarization | |
| Ligand | Accelerator | Anodic | Cathodic |
| N,N,N',N'-tetrakis-(2-hydroxypropyl)ehtylenediamine | Cytosine | 79 | 28 |
| | Adenine | 82 | 31 |
| | Benzotriazole | 72 | 27 |
| | Sodium 2-mercapto- | | |

TABLE I-continued

| Anodic and Cathodic Percent Depolarization | | | |
|---|---|---|---|
| | | Percent Depolarization | |
| Ligand | Accelerator | Anodic | Cathodic |
| | benzothiazole | 79 | 37 |
| | Pyridine | 70 | 20 |
| | Guanidine | 0 | 49 |
| EDTA | Cytosine | 78 | 56 |
| | Guanidine | 0 | 52 |
| Tartrate | Cytosine | 0 | 35 |
| | Guanidine | 0 | 35 |

As shown in Table I, the agents of this invention can selectively accelerate the cathodic partial reaction, or simultaneously accelerate the anodic and the cathodic partial reactions, to the same or a different extent.

Cathodic and anodic depolarizations caused by the presence of an accelerating agent can be additive, as shown in Table II. The gravimetric accelerating factor A is defined as the ratio between the rate of electroless metal plating in the presence of the additive and the rate in the absence of the additive. The percent depolarization measurements in Table II were made using the same electroless metal deposition solutions and the same equipment as were used in obtaining the data of Table I.

TABLE II

| Gravimetric Accelerating Factor A and Total Depolarization | | | | | | | |
|---|---|---|---|---|---|---|---|
| | | Rate of Electroless Plating (gravimetric) microns/hr. | | Gravimetric Accelerating Factor | Percent Depolarization | | |
| Ligand | Accelerator | Without Accelerator | With Accelerator | A | Anodic | Cathodic | Total |
| Tartrate | Cytosine | 0.5 | 0.9 | 1.8 | 0 | 35 | 35 |
| N,N,N',N'-tetrakis-(2-hydroxypropyl)ethylenediamine | Cytosine | 2.8 | 6.4 | 2.3 | 79 | 28 | 107 |
| EDTA | Cytosine | 1.0 | 2.5 | 2.5 | 78 | 56 | 134 |

As shown in Table II, inclusion of cytosine with appropriate pH regulations as taught herein caused an increase in plating rate of from 180 to 250 percent, depending upon the ligand present in the electroless copper solution. Such results were surprising and unpredictable.

In addition to the classes of compounds specifically mentioned herein, many other classes of depolarizing compounds are known in the electrochemical arts. It is to be understood that such compounds are also contemplated for use in this invention.

DESCRIPTION OF THE SPECIFIC EMBODIMENTS

The process of this invention is illustrated by the following examples, which are not to be construed as limiting.

In the examples, plating rates were determined by using either a "gravimetric" or a "burn-out" test.

In the "gravimetric" technique, a stainless steel foil, 5 centimeters in length and 3 centimeters in width, was first cleaned and then sensitized by immersing in a palladium chloride/hydrochloric acid solution for about 1 minute, followed by a water rinse. The foil was then immersed in the plating bath for about 15 minutes, rinsed and dried at 100° C. for about 20 minutes, weighed and then treated with nitric acid to etch off all of the deposited copper. The foil was then rinsed, dried and re-weighed. The thickness of the copper deposit was computed from the weight of copper plated and the known surface dimensions of the foil.

In the "burn-out" test, a copper clad epoxy-glass insulating laminate having a thickness of 0.062 inches and multiple non-copper clad through holes having an outside diameter of 0.040 inches, was cleaned with an aqueous solution of ALTREX, BASF-Wyandotte Corp., an alkaline cleaning agent, at a concentration of 45 grams per liter in water and a temperature of 50° C. to remove surface dirt and thereafter rinsed with water. The copper clad surface was then cleaned with a 10 percent aqueous solution of sodium persulfate and rinsed with water. Following this, the laminate was sequentially contacted with 10 percent sulfuric acid, rinsed with water and contacted with 30 percent hydrochloric acid. The non-copper clad through holes were then sensitized to the electroless deposition of copper by contacting for 5 minutes at room temperature with OXYTRON ACTIVATOR 316, a palladium chloride/tin chloride sensitizing solution commercially available from Sel-Rex Co., a division of O.M.F. Corp., Nutley, N.J. After contacting with the sensitizing solution, the laminate was rinsed with water and contacted with a 5 percent fluoboric acid solution by volume also containing 4 g/l of N-(2-hydroxyethyl)ethylenediamine triacetic acid, to remove excess tin salt and, again, rinsed with water. The laminate was then immersed in an electroless copper plating solution, as described hereinafter, for 15–30 minutes, to deposit from 2 to 4 microns of copper. More specifically, the laminate was immersed in the plating solution for 15 minutes in the case of Bath A, or 30 minutes in the case of Bath B and Bath C. After plating, rinsing and drying, the maximum electrical current carrying capacity of the copper following deposition was then measured using the burn-out test described in co-pending Application Ser. No. 926,074, filed July 19, 1978, which has a common assignee to this application and which is incorporated herein by reference. Briefly, current is applied across one or more of the copper plated through holes in the laminate at a constant increasing rate of 3 amperes per second starting from zero, until the maximum current carrying capacity of the conductive copper in the through hole is reached. At this point, the copper in the through hole fuses and burns out and the current value at burn out is determined by means of an ammeter. The value of the burn out corresponds to the copper thickness in the through hole, by the relationship:

$$\text{copper current} = 0.2 \times \frac{\text{burn out thickness}}{\text{hole diameter}}$$

The plating rate is determined in microns per hour from the copper thickness and the immersion time. In the examples, "burn-out" test data are identified by the designation "BO". All data not so identified in the examples were obtained using the "gravimetric" technique.

EXAMPLE 1

This example illustrates the use of pyridine, a heterocyclic aromatic nitrogen compound, as an agent to accelerate the copper plating rate in a bath having the following composition.

| BATH A | |
|---|---|
| N,N,N'-N'-tetrakis (2-hydroxypropyl)ethylenediamine | 34 g/l |
| $CuSO_4 . 5H_2O$ | 18 g/l |
| Formaldehyde (37% Soln.) | 20 ml/l |
| Wetting Agent (PLURONIC P-85, BASF-Wyandotte Co.) | 0.001 g/l |
| Sodium hydroxide | to desired pH |

Figure 2:
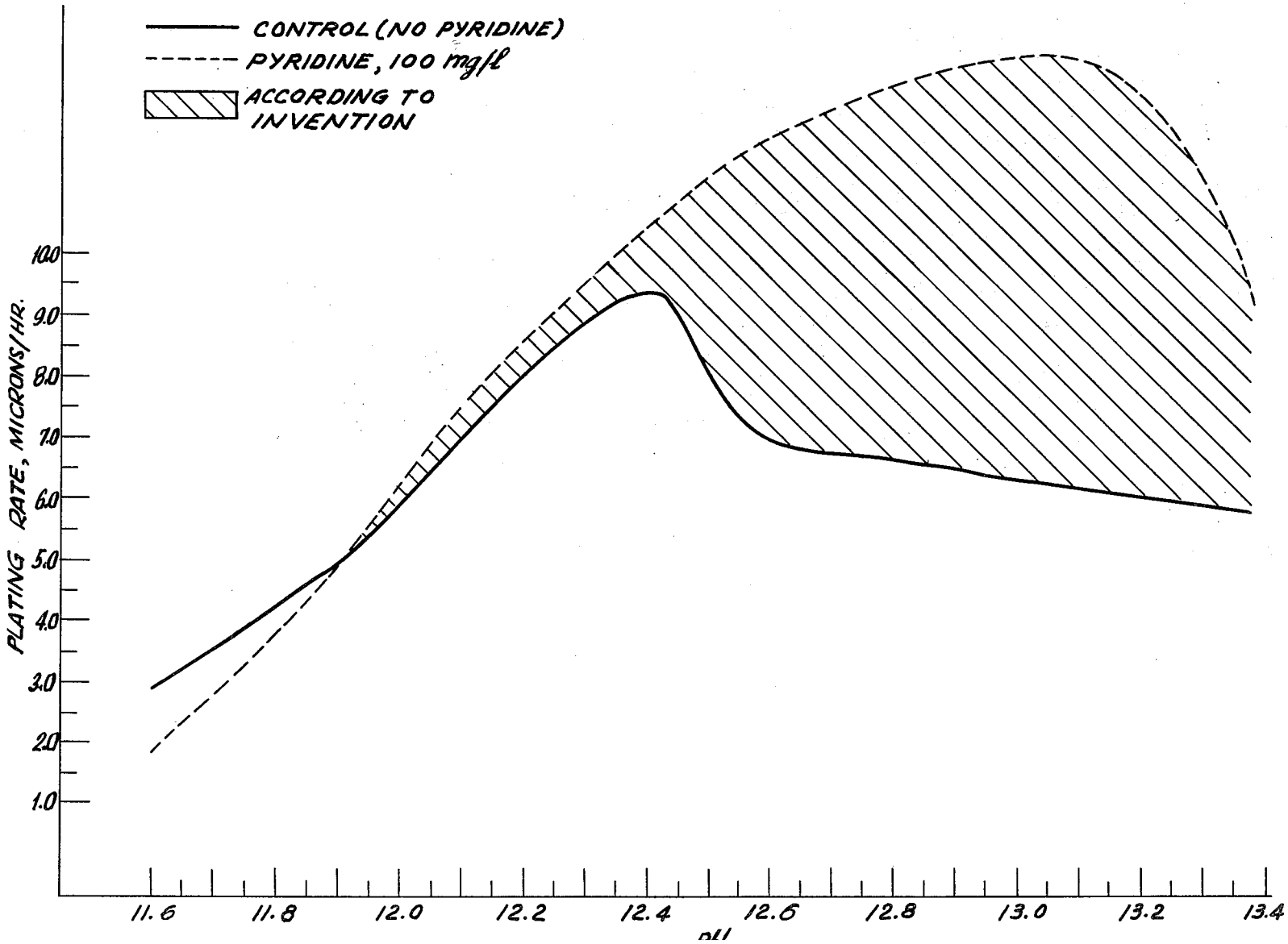
FIG. 2 is a graph in which plating rate and pH are plotted to show the effect on plating rate by one accelerator according to the invention.

Bath A, to which 0.1 g/l (100 mg/l) of pyridine was added, was run at 25° C. The effect of the presence of pyridine and the inter-regulating thereof with pH on the copper plating rate as taught herein is shown by the plating rate data in the table and FIG. 2. For purposes of comparison, plating rate data was also taken for Bath A without pyridine and that data is also summarized in the table below and in FIG. 2.

| BATH A* | | BATH A + Pyridine | |
|---|---|---|---|
| pH | Plating rate, microns/hr. | pH | Plating rate, microns/hr. |
| 12.4 | 9.5** (BO) | 12.4 | 10.7 (BO) |
| 13.1 | 6.3 | 13.1 | 14.2** |

*comparison experiment
**peak plating rate

EXAMPLE 2

The procedure of Example 1 is repeated, except that 14.3 g copper acetate is substituted for $CuSO_4.5H_2O$ and 0.005 g/l of 2-mercaptopyridine (a heterocyclic aromatic nitrogen compound) is used as the plating rate accelerating agent in the bath. The results are summarized as follows:

| BATH A* | | BATH A + 2-mercaptopyridine | |
|---|---|---|---|
| pH | Plating rate, microns/hr. | pH | Plating rate, microns/hr. |
| 12.4 | 9.5** (BO) | 12.4 | 12.5 (BO) |
| 12.8 | 6.7 | 12.8 | 14.0 |

*comparison experiment
**peak plating rate

EXAMPLE 3

This example illustrates the effect of combining two plating rate accelerating agents according to this invention, 2-mercaptobenzothiazole sodium salt and 2-hydroxypyridine, which are heterocyclic aromatic nitrogen compounds. Using these two agents in combination in bath A, the plating procedure of Example 1 is repeated, and the results are summarized as follows:

| | | | | | | |
|---|---|---|---|---|---|---|
| 2-mercaptobenzothiazole sodium salt, g/l | 0* | 0.002** | 0** | 0** | 0.002 | 0.002 |
| 2-hydroxypyridine, g/l | 0 | 0 | 0.001 | 0.005 | 0.001 | 0.005 |
| pH | 13.3 | 13.3 | 13.0 | 13.0 | 13.3 | 13.3 |
| plating rate, microns/hr. | 5.8 | 11.7(BO) | 7.9 | 11.5 | 12.3 | 13.3 |

*control experiment in the sense that no accelerating agent is present
**control experiment in the sense that only one of the two accelerating agents is present It is shown that the combination of 2-hydroxypyridine and 2-mercaptobenzothiazole provides a faster plating rate than either of the two compounds alone and a copper deposit which is bright and shiny. When used alone, 2-mercaptobenzothiazole provides a more stable bath in comparison with the control without either of the two compounds present, but the deposited copper is not as bright and shiny as desirable. On the other hand, the use of 2-hydroxypyridine, by itself, results in a copper deposit which is bright and shiny in comparison with the control bath having only 2-mercaptobenzothiazole present or the control without either of the two compounds.

EXAMPLE 4

The procedure of Example 1 is repeated, except that p-nitrobenzylamine hydrochloride, an aromatic amine, is used as the plating rate accelerating agent in bath A, in an amount of 0.1 g/l. The results are summarized as follows:

| BATH A* | | BATH A + p-nitrobenzylamine HCl | |
|---|---|---|---|
| pH | Plating rate, microns/hr. | pH | Plating rate, microns/hr. |
| 12.4 | 9.5** (BO) | 12.4 | 10.5 (BO) |
| 12.9 | 6.3 | 12.9 | 11.8 (BO) |

*comparison experiment
**peak plating rate

EXAMPLE 5

The procedure in Example 1 is repeated, except that 2,2'-dipyridyl, in the amount of 0.005 g/l, is used as the plating rate accelerating agent in bath A. The results are summarized as follows:

| BATH A* | | BATH A + 2,2'-dipyridyl | |
|---|---|---|---|
| pH | Plating rate, microns/hr. | pH | Plating rate, microns/hr. |
| 12.4 | 9.5** (BO) | 12.4 | 10.3 (BO) |
| 12.7 | 7.0 | 12.7 | 11.0** (BO) |

*comparison experiment
**peak plating rate

EXAMPLE 6

This example illustrates the effect of increasing the temperature on the plating rate in a process according to this invention.

Using the procedure of Example 1, the plating rate of copper in bath A also containing 2-mercaptobenzothiazole is measured at 26° C., 38° C. and 70° C. The results are summarized as follows:

| | | | |
|---|---|---|---|
| 2-mercaptobenzothiazole sodium salt, g/l | 0.002 | 0.002 | 0.002 |
| pH (measured at room temperature) | 13.2 | 13.2 | 13.2 |
| Temperature, °C. | 26 | 38 | 70 |
| Plating rate, microns/hr. | 13.0(BO) | 19.3 | 65 |

It is shown that, all other conditions being substantially the same, the plating rate undergoes an increase as the temperature is raised. Also, it is observed that the copper deposit has reduced internal stress. At 70° C., the bath was modified by lowering the formaldehyde concentration to 12 ml/l. Mention should be made of the fact that the 65 microns/hr. plating rate achieved with the 70° C. bath is extraordinary. Also considerably noteworthy is 19.3 microns/hr. plating rate achieved with the bath when operated at 38° C.

EXAMPLE 7

This example illustrates the effect of using a Group VIII metal in combination with a plating rate accelerating agent in accordance with this invention.

The procedure of Example 1 is repeated, using electroless copper deposition baths having the composition stated in the table below. As shown by the data in the Table, the presence of a Group VIII metal further enhances the plating rate of the electroless copper plating solutions of this invention.

| | | | | | | |
|---|---|---|---|---|---|---|
| N,N,N',N'-tetrakis(2-hydroxypropyl) ethylenediamine | 34 g/l | 34 g/l | 34 g/l | 34 g/l | 34 g/l | 34 g/l |
| $CuSO_4 . 5H_2O$ | 18 g/l | 18 g/l | 18 g/l | 18 g/l | 18 g/l | 18 g/l |
| formaldehyde (37%) | 20 ml/l | 20 ml/l | 20 ml/l | 20 ml/l | 20 ml/l | 20 ml/l |
| wetting agent (BASF-Wyandotte's PLURONIC P-85) | 0.001 g/l | 0.001 g/l | 0.001 g/l | 0.001 g/l | 0.001 g/l | 0.001 g/l |
| NaOH | to pH | to pH | to pH | to pH | to pH | to pH |
| 2-mercaptobenzothiazole sodium salt, g/l | 0.002* | 0.002 | 0.002* | 0.002 | 0.0015* | 0.0015 |
| $NiSO_4 . 6H_2O$, g/l | 0 | 1 | 0 | 0 | 0 | 0 |
| $CoCl_2 . 2H_2O$, g/l | 0 | 0 | 0 | 4.5 | 0 | 0 |
| $PdCl_2$, g/l | 0 | 0 | 0 | 0 | 0 | .01 |
| Sodium potassium tartrate, g/l | 0 | 1.6 | 0 | 4.5 | 0 | 0 |
| pH | 13.4 | 13.4 | 13.2 | 13.2 | 13.2 | 13.2 |
| Plating rate, microns/hr. | 10.4 | 19 | 12.8 | 15.0 | 9.0 | 12.0 |

*control experiment in the sense that a Group VIII metal is not present

In Examples 1–7, it will be seen that operation in the presence of the additive(s) as taught herein results in a marked increase on the plating rates of the electroless deposition solutions, compared with the control bath. In addition, the additive(s) containing solutions of Examples 1–7 produce an adherent, substantially non-stressed copper deposit, whereas the control bath without the additive(s) produced a non-adherent copper deposit which tended to flake off the substratum.

EXAMPLE 8

This example illustrates the use of cytosine, a plating rate accelerating agent according to this invention, to accelerate the rate of copper deposition in a bath having the following composition:

| BATH B | |
|---|---|
| Tetrasodium ethylenediamine tetraacetate dihydrate | 138 g/l |
| $CuSO_4 . 5H_2O$ | 14.7 g/l |

-continued

| BATH B | |
|---|---|
| Formaldehyde (37% Soln.) | 30 ml/l |
| NaOH | to pH |

Using the procedure for determining the plating rate described above, a stainless steel foil having the dimensions 3 cm×5 cm is catalyzed for electroless metal deposition and electrolessly placed with copper at 25° C. in bath B, to which 0.004 g/l (4 mg/l) of cytosine has been added.

Figure 3:
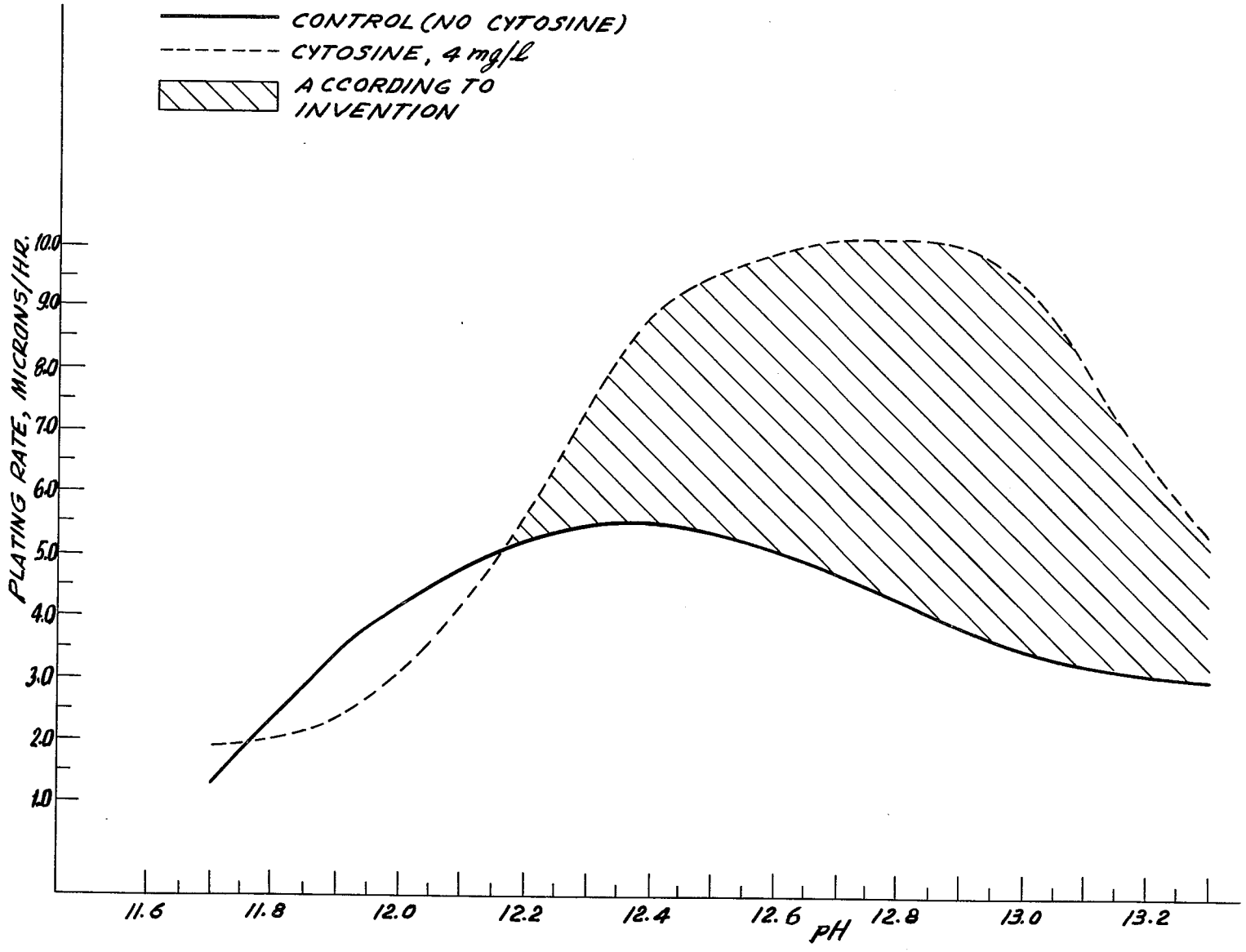
FIG. 3 is a graph similar to FIG. 2 but showing the effect on plating rate by a different accelerator.

The effect of the presence of cytosine and the change in pH on the plating rate of copper is shown in the table and FIG. 3. For purposes of comparison, the effect of the change in pH on the copper plating rate in bath B without cytosine is also shown.

| BATH B* | | BATH B + cytosine | |
|---|---|---|---|
| pH | Plating rate, microns/hr. | pH | Plating rate, microns/hr. |
| 12.4 | 5.3** | 12.4 | 9.3 |
| 12.75 | 4.5 | 12.75 | 10.4** |

*control experiment
**peak plating rate

EXAMPLE 9

The procedure of Example 8 is repeated, except that 2-mercaptobenzothiazole, in the amount of 0.005 g/l, is used as the plating rate accelerating agent. The results are summarized as follows:

| BATH B* | | BATH B + 2-mercaptobenzothiazole | |
|---|---|---|---|
| pH | Plating rate, microns/hr. | pH | Plating rate, microns/hr. |
| 12.4 | 5.3 | 12.4 | 11.0** |
| 13.1 | 3.5 | 13.1 | 7.3 |

*control experiment
**peak plating rate

EXAMPLE 10

Figure 4:
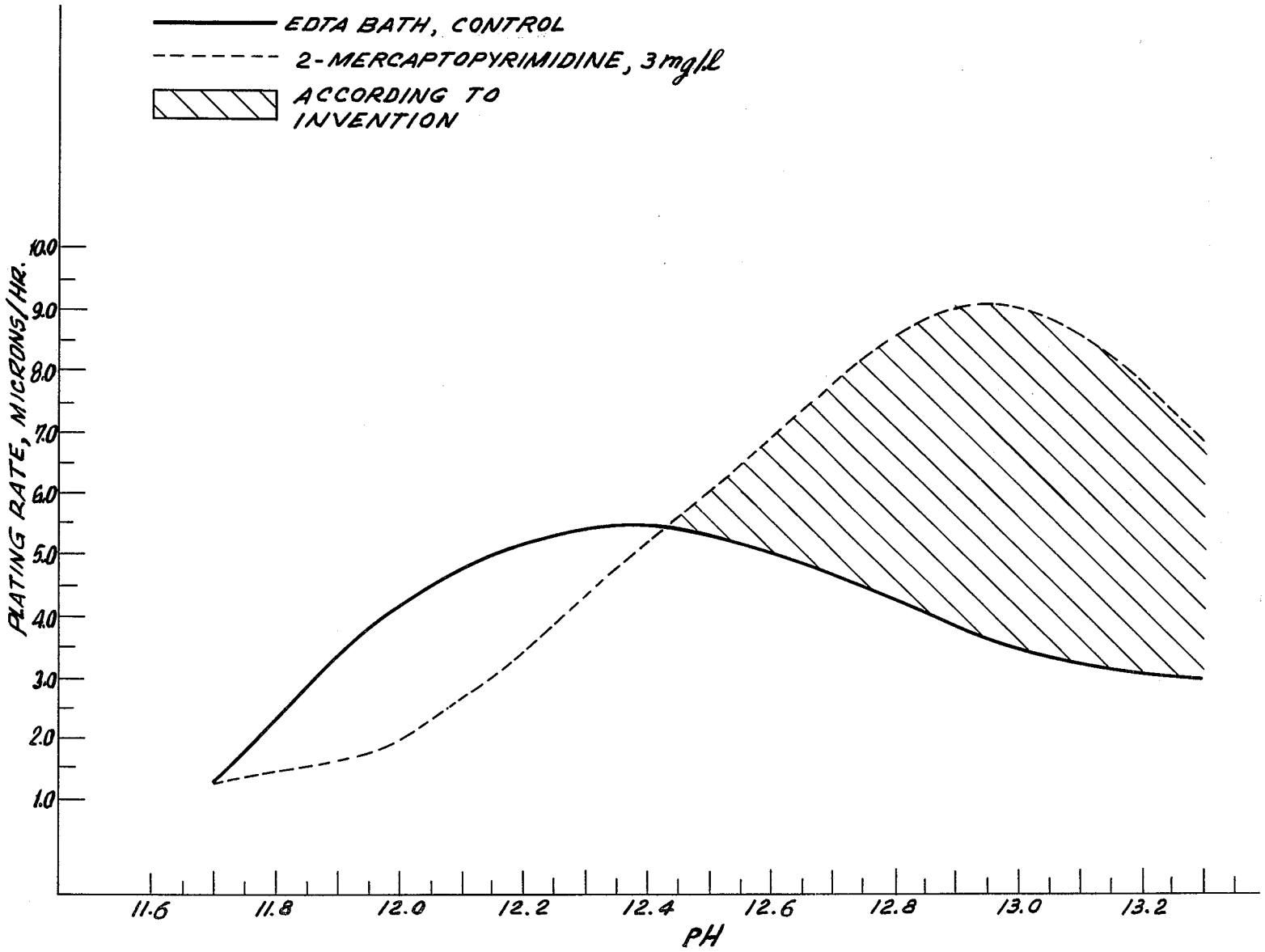
FIG. 4 is a graph similar to FIGS. 2 and 3 but showing the effect on plating rate of a still different accelerator; and, FIG. 5 is a graph similar to FIGS. 2, 3 and 4 but showing the plating rate effect of a still different accelerator.

The procedure of Example 8 is repeated, except that 2-mercaptopyrimidine, in the amount of 0.003 g/l, is used as the accelerating agent. The results are shown in FIG. 4 and summarized as follows:

| BATH B* | | BATH B + 2-mercaptopyrimidine | |
|---|---|---|---|
| pH | Plating rate, microns/hr. | pH | Plating rate, microns/hr. |
| 12.4 | 5.3** | 12.4 | 5.3 |
| 13.0 | 3.5 | 13.0 | 8.8** |

*control experiment
**peak plating rate

EXAMPLE 11

Figure 5:
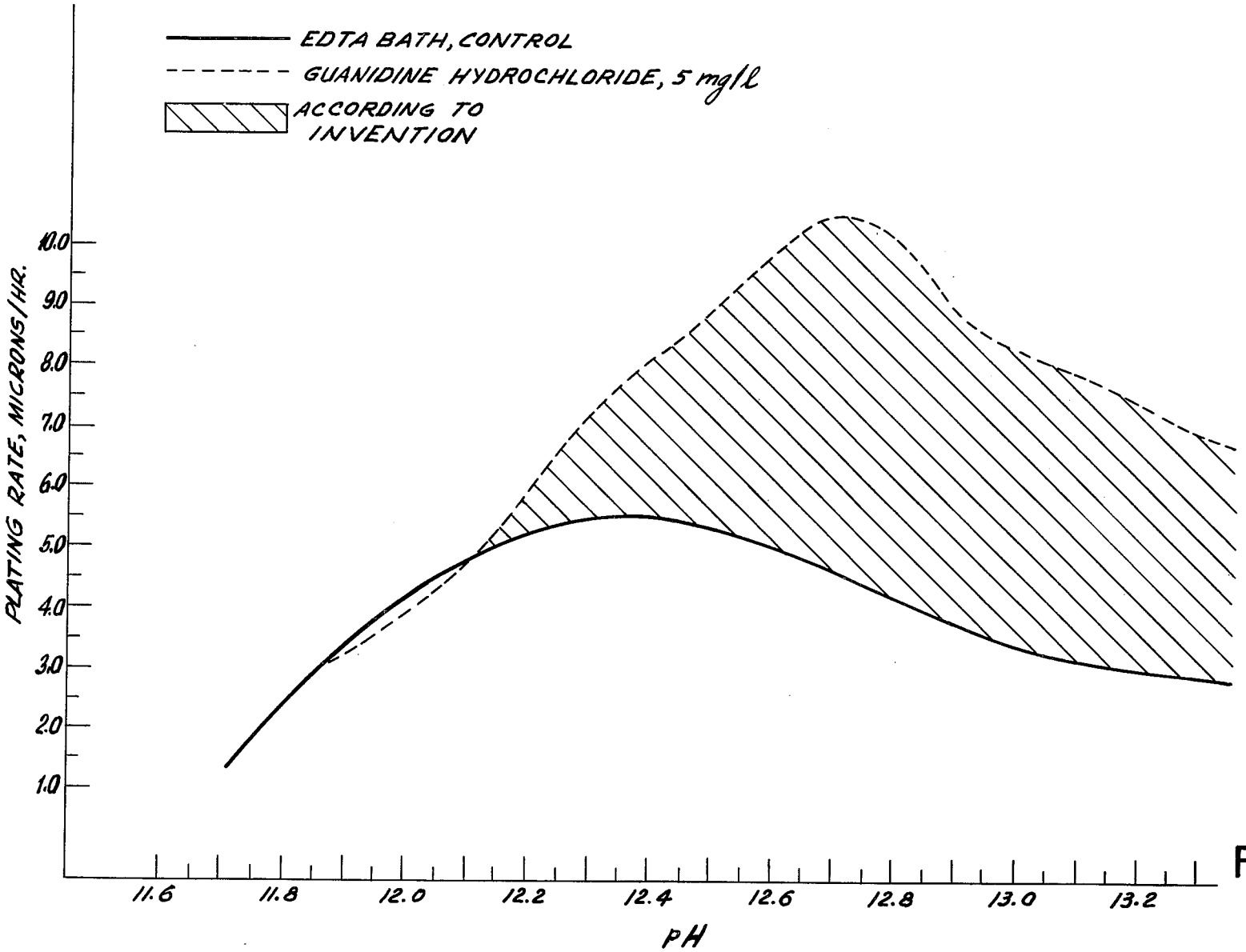

The procedure of Example 8 is repeated, except that guanidine hydrochloride, a non-aromatic nitrogen compound, is used as the plating rate accelerating agent, in the amount of 0.005 g/l (5 mg/l). The results as shown in FIG. 5 and summarized in the following table.

| BATH B* | | BATH B + guanidine HCl | |
|---|---|---|---|
| pH | Plating rate, microns/hr. | pH | Plating rate, microns/hr. |
| 12.4 | 5.3** | 12.4 | 8.0 |
| 12.72 | 4.4 | 12.72 | 10.5** |

*control experiment
**peak plating rate

With respect to Examples 8 to 11, it will be noted that operation in the presence of the additives as taught herein leads to a marked increase in the plating rate of the solution, compared with the non-additive containing control.

EXAMPLE 12

This example illustrates a particularly effective composition for practicing the invention and the results achieved therewith.

| | |
|---|---|
| Copper sulfate | 18 g/l |
| Quadrol | 36 g/l |
| Pluronic P-85 wetting agent | 1 mg/l |
| 2-mercaptobenzothiazole | 1.5 mg/l |
| $NiSO_4 . 6H_2O$ | 0.61 g/l |
| Rochelle salt | 1 g/l |
| | (37% soln.) |
| Formaldehyde | 12 ml/l |
| NaOH | 37 g/l |
| 4-hydroxypyridine | 40 mg/l |
| pH | 13.15 (measured at 25° C.) |
| Temperature | 70° C. |
| Rate | 32 microns/hr. |
| Ductility | 2 bends |
| Bath Stability | very good. |

It will be noted that in addition to having a fast rate, the bath of Example 12 produced copper of great ductility.

EXAMPLE 13

This example further illustrates the electrolessly fast plating rate achieveable by practice of the invention.

| | |
|---|---|
| Copper sulfate | 18 g/l |
| Quadrol | 34 g/l |
| | 37% soln. |
| Formaldehyde | 15 ml/l |
| Pluronic P-85 wetting agent | 1 mg/l |
| 2-mercaptobenzothiazole | 1.5 mg/l |
| pH | 13.2 |
| 4-hydroxypyridine | 40 mg/l |
| Polyox coagulant, Union Carbide Corp. | 1 mg/l |
| Rate | 72 microns/hr. |
| Temperature | 70° C. |

EXAMPLE 14

This example illustrates the practice of the invention using a highly concentrated solution. With such highly concentration bath, the need for frequent batch wise or continuous replenishment is reduced or eliminated.

| BATH C | |
|---|---|
| N,N,N',N'-tetrakis (2-hydroxypropyl)ethylenediamine | 65.4 g/l (.22 mole/l) |
| $CuSO_4 . 5H_2O$ | 50 g/l (.20 mole/l) |
| Formaldehyde (37% soln.) | 20 ml/l (.27 mole/l) |
| Wetting agent (PLURONIC P-85, | 0.001 g/l |

-continued

| BATH C | |
|---|---|
| BASF-Wyandotte Co.) | |
| Sodium hydroxide | 3.9 g/l (9.1 mole/l) |
| pH | 13.2 |
| Temperature | 25° C. |

In Example 14, the gravimetric test for plating rate was done using a copper rather than a stainless steel plate. For comparison, dilute Bath A of Example 1 was run using the same type of copper plates as the deposition substratum. The results are tabulated below.

| Bath | Cytosine (mg/l) | Plating Rate (microns/hr.) |
|---|---|---|
| A | 0 | 3.6 |
| C | 0 | 4.0 |
| C | 5 | 7.9 |
| C | 10 | 9.8 |
| C | 15 | 10.5 |
| C | 20 | 11.3 |
| C | 40 | 9.1 |

Given the concentrate of the plating solution, the plating rates achieved with the cytosine present were unexpected. These rates achieved in this example illustrate the efficacy of the teachings herein to very concentrated plating solutions. Heretofore the practice in the art has been to use dilute solutions, i.e., solutions containing less than 0.1 mole/l of copper salt, and generally about 0.06 mole/l. By practice of the teachings herein, electroless copper solutions of greater than 0.1 mole of copper salt can be used to achieve plating rates of greater than 7 microns per hour. A comparison of Baths A and C also shows that in these baths without the cytosine present, increasing the copper concentration in the bath (18 g/l of $CuSO_4.5H_2O$ in Bath A versus 50 g/l of the same salt in Bath C) has no significant effect in the plating rate. Rather, it is the presence of the cytosine, interregulated with the pH, which results in the plating rate increases.

In addition to the above embodiments, special mention is made of electroless copper deposition processes according to this invention wherein the accelerating agent consists of 2-mercaptobenzothiazole in combination with imidazole or 4-hydroxypyridine, which leads to brighter deposits of copper in comparison with no accelerating agent or 2-mercaptobenzothiazole alone; and processes wherein the accelerating agent consists of pyridine in combination with 2-mercaptobenzothiazole, which leads to enhancements in stability in comparison with pyridine alone, as well as brighter deposits of copper in comparison with 2-mercaptobenzothiazole alone.

Especially preferably, the plating rate accelerating agent is selected from among 2-mercaptobenzothiazole, 4-hydroxypyridine, 2-mercaptopyridine, aminopyrazine, pyrido (2,3,b)pyrazine, cytosine, guanidine hydrochloride, pyridine, 2-hydroxypyridine, para-nitrobenzylamine hydrochloride, imidazole and mixtures thereof.

Because of the fast rate of copper deposition from the solutions made in accordance with this invention, frequent replenishment may be necessary if dilute solutions are used. Surprisingly, it is possible to practice this invention using highly concentrated plating solutions. See, e.g., Example 14. Heretofore, the practice in the art has been to use dilute solutions.

In general, there may be used as the depolarizing agent any agent which, when added to the solution, produces at least a 20 percent and preferably at least 30 percent depolarization of the anodic partial reaction or the cathodic partial reaction of the solution, or both.

By way of illustrating the use of this invention in the manufacture of printed circuit boards, prior to electroless metal deposition a copper clad epoxy-glass laminate is drilled to provide multiple through holes. The surface and the holes are cleaned with an alkaline cleaning solution, e.g., ALTREX, BASF-Wyandotte Corp., at a concentration of 45 grams per liter and a temperature of 50° C., and thereafter rinsed with water. The copper clad surface is then cleaned with a 10 percent aqueous solution of sodium persulfate and the surface is rinsed with water. The laminate is sequentially contacted with 10 percent sulfuric acid, rinsed with water and contacted with 30 percent hydrochloric acid.

After the pre-treatment, the non-copper clad hole barrels are catalyzed for electroless copper deposition in the standard manner using a palladium/tin salt catalyst, rinsed briefly with water, treated with 5 percent fluoroboric acid solution to remove excess tin salt, and again rinsed with water. The epoxy-glass laminate is now ready for treatment by a process according to this invention.

The catalyzed epoxy-glass laminate is immersed in an electroless copper deposition bath (any of the above-described) to deposit 2–4 microns of copper, typically.

After an initial deposit of copper in the hole barrels is obtained, e.g., 2–4 microns, portions of the copper clad surface are covered with a masking material, e.g., RISTON 310, a dry film photoresist sold by E.I. DuPont DeNemours Co., Inc., copper is built up on the unmasked areas by conventional electroplating, and followed by electroplating tin-lead alloy (an etch resist). The masking is stripped off using a mild alkali, e.g., 4–15 percent solution of NaOH, and the background copper in the previously masked areas is etched away, e.g., using ammoniacal $CuCl_2$. The product is an epoxy-glass laminate having a pattern of copper conductor lines on the surface, and copper interconnections in the through-holes, all coated with tin-lead.

It will be clear from the examples that the complexing agent preferred for use herein is N,N,N'-N'-tetrakis (2-hydroxypropyl)ethylenediamine (i.e., Quadrol). Good results are also obtained using ethylenediamine tetraacetic acid and its salts. The least preferred complexing agent are tartrate salts, e.g., Rochelle salts.

Other modifications and variations of the present invention are possible in the light of the above disclosure. It is therefore to be understood that changes may be made in the particular embodiments described which are within the full intended scope of the invention as defined by the appended claims.

The invention in its broader aspects is not limited to the specific steps, processes and compositions shown and described but departures may be made therefrom within the scope of the accompanying claims without departing from the principles of the invention and without sacrificing its chief advantages.

We claim:

1. In a method for electrolessly depositing copper from an electroless copper deposition solution which comprises copper ions, a complexing agent for copper ions, a reducing agent and a pH adjustor and which is characterized by a plating rate which first increases and passes through a peak plating rate and then decreases as a function of pH above 10, the improvement for depositing at a rate greater than about 7 micrometers of electroless copper per hour in a bath composition operated at a temperature of about 25° C. to about 35° C. to a rate greater than 19 micrometers of electroless copper per hour in a bath composition operated at a temperature above 35° C., a coherent, structurally stable thin film of electroless copper adherent to a substratum, comprising:

(A) including within the electroless copper deposition solution an accelerating agent which contains a delocalized pi-bond and is selected from among
  (a) heterocyclic aromatic nitrogen and and sulfur compounds,
  (b) non-aromatic nitrogen compounds having at least one delocalized pi-bond,
  (c) aromatic amines, and
  (d) mixtures of any of the foregoing;

(B) contacting the electroless copper deposition solution with a substratum sensitive to the deposition of electroless copper; and (C) while operating the electroless copper deposition solution at a pH above 10, regulating the pH thereabove and the amount of said accelerating agent therein to maintain a deposition within said rate, to thereby achieve a coherent, structurally stable thin film of electroless copper adhered to the surface of said substratum.

2. The method of claim 1 wherein the accelerating agent is selected from among 2-mercaptobenzothiazole, 4-hydroxypyridine, 2-mercaptopyridine, aminopyrazine, pyrido (2,3,b) pyrazine, cytosine, guanidine hydrochloride, pyridine, 2-hydroxypyridine, para-nitrobenzylamine hydrochloride, imidazole and mixtures thereof.

3. The method of claim 1 wherein the accelerating agent is present in an amount of at least about 0.0001 gram per liter of the electroless metal depostion solution.

4. The method of claim 30 wherein the accelerating agent is present in an amount of from about 0.0001 to about 2.5 grams per liter.

5. The method of claim 1 wherein the accelerating agent has a free electron pair on a nitrogen atom adjacent to a pi-bond.

6. The method of claim 1 wherein the electroless metal deposition solution includes an ion of at least one metal selected from Group VIII of the Periodic Table of the Elements.

7. The method of claim 6 wherein said copper ion is supplied as a salt and said metal ion is present in an amount of from about 0.005 to about 30% by weight, based on the weight of the copper salt.

8. The method of claim 6, in which the Group VIII metal is cobalt or nickel or both.

9. The method of claim 1 wherein the reducing agent is selected from among formaldehyde and precursors or derivatives thereof, boranes, borohydrides, hydroxylamines, hydrazines and hypophosphite.

10. The method of claim 1 wherein the pH adjustor is an alkali metal hydroxide or alkaline earth metal hydroxide.

11. The method of claim 1 in which the electroless copper deposition solution is capable of electrolessly depositing copper at a rate of not less than 7 and up to at least 30 microns of electroless copper per hour for a period of at least 15 minutes, when measured at room temperature.

12. The method of claim 1, in which the deposition solution is operated at a temperature between 20° and 70° C.

13. The method of claim 1, in which the deposition solution is operated at a temperature of about 25° C.

14. A method for depositing a coherent, structurally stable thin film of copper from an electroless copper deposition solution having a pH greater than 10 at a rate of between about 9 micrometers and 25 micrometers of electroless copper per hour in a bath composition operating at about 25° C. to about 35° C. to a rate greater than 19 micrometers of electroless copper per hour in a bath composition operated at a temperature above 35° C. which comprises including within the deposition solution an agent which produces depolarization of the anodic partial reaction of the solution or the cathodic partial reaction of the solution or both reactions, and while operating the solution at a pH above 10, regulating the pH thereabove and the amount of said agent so as to maintain the deposition at said rate.

15. The electroless deposition method of claim 14 wherein the agent causes at least a 20% and up to 100% depolarization of the anodic partial reaction of the solution.

16. The electroless deposition method of claim 15 wherein the agent causes at least a 20% and up to 100% depolarization of the cathodic partial reaction of the solution.

17. The electroless deposition method of claim 15 wherein the agent causes at least a 20% and up to 100% depolarization of both the anodic and cathodic partial reactions of the solution.

18. The method of claim 15 which further comprises including in the electroless copper deposition solution a nonionic block copolymer of ethylene oxide and propylene oxide.

19. The method of claim 14 which further comprises including in the electroless copper deposition solution a nonionic block copolymer of ehtylene oxide and propylene oxide.

20. The method of claim 14 in which the electroless copper deposition solution is capable of electrolessly depositing copper at a rate of not less than 9 and up to at least 25 microns of electroless copper per hour for a period of at least 15 minutes.

21. The method of claim 14, in which the deposition solution is operated at a temperature of about 25° C.

22. The method of claim 14, in which the depolarizing agent contains a delocalized pi-bond and is selected from among
  (a) heterocyclic aromatic nitrogen and sulfur compounds,
  (b) non-aromatic nitrogen compounds having at least one delocalized pi-bond,
  (c) aromatic amines, and
  (d) mixtures of any of the foregoing.

* * * * *